United States Patent [19]

Satake et al.

[11] Patent Number: 5,051,718

[45] Date of Patent: Sep. 24, 1991

[54] THERMISTOR ELEMENT AND GAS SENSOR USING THE SAME

[75] Inventors: Kazuko Satake, Yokohama; Ai Kobayashi, Kamakura, both of Japan

[73] Assignee: Tokuyama Soda Kabushiki Kaisha, Yamaguchi, Japan

[21] Appl. No.: 584,175

[22] Filed: Sep. 18, 1990

[30] Foreign Application Priority Data

Sep. 18, 1989 [JP] Japan ..... 1-240106

[51] Int. Cl.[5] ..... H01C 7/00; H01C 7/10

[52] U.S. Cl. ..... 338/34; 338/22 R; 338/225 D

[58] Field of Search ..... 338/22 R, 225 D, 34, 338/35; 123/440, 489; 219/10.55 B; 422/98, 83

[56] References Cited

U.S. PATENT DOCUMENTS

| | | | |
|---|---|---|---|
| 3,729,575 | 4/1973 | Harding et al. | 338/22 R X |
| 4,208,786 | 6/1980 | Merchant et al. . | |
| 4,338,174 | 7/1982 | Tamura | 338/22 R X |
| 4,520,653 | 6/1985 | Kaiser . | |
| 4,747,930 | 5/1988 | Kojima et al. . | |

FOREIGN PATENT DOCUMENTS 1345735 2/1974 Fed. Rep. of Germany .

*Primary Examiner*—Marvin M. Lateef

*Attorney, Agent, or Firm*—Sherman and Shalloway

[57] ABSTRACT

A thermistor element composed substantially of a vanadium-containing titania having dissolved therein 0.01 to 10 at. %, based on titanium, of vanadium and optionally 10 at. % or less, based on titanium, of at least one element selected from the group containing of cobalt, copper, manganese, iron, nickel, bismuth, strontium, barium, lead and zinc. A gas sensor using the thermistor element as a temperature sensor is described.

8 Claims, 3 Drawing Sheets

THERMISTOR ELEMENT AND GAS SENSOR USING THE SAME

This invention relates to a thermistor element having a quite low sensitivity to nitrogen oxides (NOx), CO, $O_2$, etc. and good temperature-resistance characteristics at high temperatures, as well as a gas sensor using the thermistor element as a temperature sensor.

In a gas sensor for sensing NOx, CO, $O_2$, etc. in a gas being sensed, comprising a metal oxide semiconductor, change in ambient temperature greatly influences characteristics of the sensor, causing a sensing error. A proposal has been therefore made to control or compensate a temperature of a gas sensor by using a thermistor element as a temperature sensor. In the above proposal, the thermistor element has been required to have characteristics that (1) within the range of temperatures used, a resistance is properly changed with the change in temperatures, (2) temperature-resistance characteristics are unchanged while the thermistor element is in use, and (3) the thermistor element is not influenced by components of a gas being sensed.

As a thermistor element usable in a high temperature atmosphere, which has been so far proposed, a thermistor element comprising a semiconductor of an oxide such as titania ($TiO_2$), niobium dioxide ($NbO_2$), etc. has been known. However, when the thermistor element is directly exposed to a gas being sensed to measure the temperature, it shows a high sensitivity to a certain component of the gas being sensed, thereby causing an error of a resistance corresponding to the temperature, or it is itself oxidized under the conditions used to notably decrease characteristics as a thermistor element. Meanwhile, a method is proposed wherein the thermistor element comprising the above oxide semiconductor is sealed into a glass ampule to isolate it from the atmosphere of the gas being sensed (see Japanese Laid-open Patent Application No. 162046/1980).

The above improved thermistor element nevertheless suffers problems such as poor heat resistance of the glass ampule, poor stability at a high temperature zone and poor response owing to high heat capacity caused by covering of the glass ampule.

In order to improve characteristics of a thermistor element comprising niobium dioxide, a thermistor element comprising niobium dioxide and a minor proportion of titanium dioxide or vanadium dioxide has been proposed (see Japanese Laid-open Patent Application No. 1679/1972). Such titanium dioxide or vanadium dioxide is added to adjust a resistance of the thermistor element, and this thermistor element has to be likewise covered by a glass ampule.

There has been also proposed a thermistor element comprising titania and whose sensitivity of a gas being sensed is decreased by increasing a sintering temperature in producing titania (see Japanese Patent Publication No. 2053/1988). The above thermistor is however only for delaying a response of the thermistor element to the components of the gas being sensed, not for basically decreasing the sensitivity to the gas.

A first object of this invention is therefore to provide a thermistor element having a quite low sensitivity to gas components in an atmosphere of a gas being sensed, showing a stable change in resistance at low to high temperatures and having a high durability.

A second object of this invention is to provide a gas sensor using the thermistor element in temperature control.

A third object of this invention is to provide a gas sensor using the thermistor element in temperature compensation.

The other objects of this invention will be clarified from the following explanation.

According to the studies of the present inventors, the objects and advantages of this invention are found to be achieved by a thermistor element composed substantially of a vanadium-containing titania having dissolved therein 0.01 to 10 at. %, based on titanium, of vanadium and optionally 10 at. % or less, based on titanium, of at least one element selected from the group consisting of cobalt, copper, manganese, iron, nickel, bismuth, strontium, barium, lead and zinc.

This invention further provides a gas sensor comprising 1) an electrical insulating support,
2) the thermistor element incorporated in the support such that a sensing portion is exposed, and
3) a gas sensor incorporated in the support such that a sensing portion is exposed.

This invention still further provides a gas sensor comprising 1) an electrical insulating support,
2) the thermistor element incorporated in the support such that a sensing portion is exposed,
3) a gas sensor incorporated in the support such that a sensing portion is exposed, and
4) a heating means for heating the thermistor element and the gas sensor element at the same temperature.

This invention will be hereinafter explained in detail.

In this invention, the thermistor element comprises titania having dissolved therein 0.01 to 10 at. %, preferably 0.01 to 8 at. %, most preferably 0.02 to at. %, based on titania, of vanadium.

When the amount, based on titanium, of vanadium dissolved is less than 0.01 at. %, it is impossible to prevent the influence of an atmosphere of gases such as NOx, CO, $O_2$, etc. When said amount is more than 10 at. %, vanadium is not completely dissolved and a durability goes insufficient. That is, vanadium is dissolved in titania in the aforesaid range to afford a thermistor element having a low sensitivity to the atmosphere of gases and a good durability.

The thermistor element comprising titania having dissolved therein vanadium in the above range can change in its element resistance to a wide extent with the change in amount of vanadium dissolved in the above range. Accordingly, the element resistance can properly be adjusted depending on conditions such as a shape of the element, a temperature range, circuit conditions, etc. Especially, when the temperature is controlled or compensated by a combination of the thermistor element and the gas sensor element to sense NOx, CO, $O_2$, etc. and they are similar to each other in resistance and temperature dependence, high-precision tempearture control or compensation is expected. Also in such usages, the characteristics can be adjusted to those suited for the gas sensor element by changing the amount of vanadium dissolved.

The thermistor element of this invention is generally molded by sintering, and may contain, in order to improve a mechanical strength of the molded article, 10% or less at. %, preferably 0.5 to 7 at. % of the other element dissolved therein unless it has an adverse effect on the characteristics of the thermistor. Examples of such other elements are Co, Cu, Zn, Mn, Fe, Ni, Bi, Pb, Sr and Ba. At least one element selected therefrom is used.

The thermistor element of this invention may further contain an inorganic insulator. Any inorganic insulator will do if it is stable under the atmosphere used of the thermistor element. Preferable examples thereof are alumina and mullite. If the inorganic insulator is mixed, its amount is usually about 30% by weight of the thermistor element.

In this invention, the shape of the thermistor element is not limited in particular, and may properly be determined according to a structure of a device used. Typical examples of said shape are a chip and a film. When the element takes the form of the chip, it can be, for example, a circular, square or elliptical thin piece. The thin piece having a thickness of 0.05 to 5 mm, preferably 0.1 to 3 mm as well as an area of one side of 0.1 to 150 $mm^2$, preferably 0.3 to 100 $mm^2$ can advantageously be utilized. When the element takes the form of the film, it can be a film having a thickness of $1\times10^{-5}$ to 0.3 mm, preferably, $1\times10^{-4}$ to 0.2 mm as well as an area of one side of 0.001 to 10 $mm^2$, preferably 0.002 to 80 $mm^2$.

The thermistor element of this invention comprises the molded article of titania and a pair of electrodes arranged in spaced-apart relationship.

In this invention, a method for producing a thermistor element is not limited in particular.

Typical examples of the method are (A) a method (indirect method) wherein a powder of titania containing vanadium dissolved therein is molded, and (B) a method (direct method) wherein titania containing vanadium dissolved therein is molded. In the indirect method (A), the powder of titania containing vanadium dissolved therein is generally produced by (i) a method wherein a vanadium-containing compound such as $V_2O_5$ or $VO(OR)_3$ (R: an alkyl group) and titania are mixed in given amounts, and the mixture is burned and dissolved, (ii) a method wherein an organometallic compound such as an alkoxide containing vanadium and titanium and titania is mixed, coprecipitated, burned and dissolved, or (iii) the above organometallic compound is heat-decomposed and dissolved. In the above methods (i) to (iii), the burning temperature may properly be selected on condition that vanadium is dissolved into titania. It is usually 500° to 1200° C. The preferable heat decomposition temperature is 500° C. to 1200° C.

It is advisable that the titania powder containing vanadium dissolved therein, which is obtained by the above method, is molded by a sintering method. For example, the titania powder containing vanadium dissolved therein is filled in a cavity of a given shape and compression-molded, and either after or simultaneously with the compression-molding, the product is heated and sintered. The pressure in the compression-molding is 200 $kg/cm^2$ to 7 $t/cm^2$; 500 $kg/cm^2$ to 2 $t/cm^2$ is generally suitable. The preferable sintering temperature is 800° C. to 1400° C. The preferable sintering atmosphere is a non-reductive atmosphere (air, $N_2$, Ar, etc.). Another sintering method is a method in which a titanium oxide powder is mixed with a dispersion medium to form a paste, and the paste is printed in the form of a film on an insulating substrate by screen printing and then sintered at the above sintering temperature in the above sintering atmosphere.

The degree of sintering is not limited in particular. The product may be, for example, either porous or compact.

An example of the direct method (B) is a method wherein a solution of an organometallic compound such as an alkoxide containing vanadium and titanium is coated on a substrate of alumina and heat-decomposed at a temperature of 500° C. to 1400° C. to form a film.

Besides the aforesaid methods (A) and (B), a sputtering method and a deposition method are also available.

In the thermistor element of this invention, any known structure can be employed if it is composed of the aforesaid titania containing vanadium dissolved therein. Especially, since the thermistor element of this invention is extremely stable in performance as a thermistor even when directly contacted with an exhaust gas, there is no need to cover it with a conventional glass ampule; the thermistor element can be directly exposed under an atmosphere of a gas being measured. Accordingly, a response speed can markedly be improved in comparison to the conventional thermistor element.

The thermistor element of this invention is used such that the surface of the chip is exposed as shown in FIGS. 2 and 4.

The thermistor element of this invention can be used singly to sense temperatures of high-temperature gases such as an exhaust gas in an internal combustion engine and a gas in an electric oven. When combined with a gas sensor element to sense gases such as NOx, CO, $O_2$, etc. said thermistor element can effectively be used as an element to control or compensate the temperature of the sensor element. When the gas sensor element has the temperature dependence in sensivitity, the thermistor element is effective for controlling the temperature. When the gas sensor element has no temperature dependence in sensitivity but temperature dependence in abrasion, the thermistor element is effective for compensating the temperature.

As the gas sensor element having such temperature dependence, a NOx gas sensor element of $Al_{0.001}Ti_{0.999-02}O_{2-\delta}$, $CdTiO_{3-\delta}$ or $In_{0.001}Ti_{0.009}O_2$. and a reductive gas sensor element of $SnO_2$ or ZnO containing a catalyst of Pd or Pt are taken. As the gas sensor element having no temperature dependence, an $O_2$ gas sensor element of $TiO_2$, $SnO_2$, $BaSnO_3$ or $Nb_2O_5$ containing a catalyst of Pt and having λ characteristics is taken.

According to this invention, there is provided, as a gas sensor having a thermistor element for temperature compensation, a gas sensor comprising 1) an electrical insulating support,
2) the thermistor element of this invention incorporated in the support such that a sensing portion is exposed, and
3) a gas sensor element incorporated in the support such that a sensing portion is exposed.

According to this invention, there is further provided, as a gas sensor having a thermistor element for temperature control, a gas sensor comprising 1) an electrical insulating support,
2) the thermistor element of this invention incorporated in the support such that a sensing portion is exposed,
3) a gas sensor element incorporated in the support such that a sensing portion is exposed,
4) a heating means for heating the thermistor element and the gas sensor element at the same temperature, and 5) optionally a sensing calculator for sensing a resistance of the thermistor element, comparing the resistance with a predetermined resistance, and adjusting the heating means such that the sensed resistance becomes the predetermined resistance.

Figure 1:
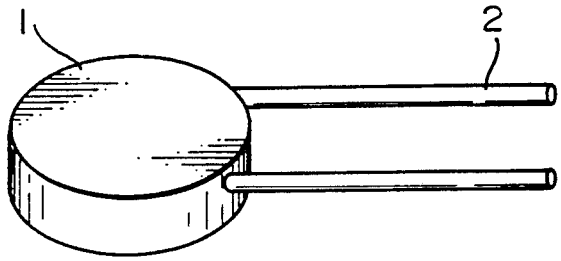
FIG. 1 shows an example of a structure in which a pair of electrodes are connected with a thermistor element of this invention.

Referring to the drawings, the thermistor element and the gas sensor of this invention will be explained hereinafter.

FIG. 1 shows the example of the structure of the thermistor element in this invention. 1 is a chip of titania containing vanadium dissolved therein. 2 is a pair of electrodes connected with the chip.

Figure 2:
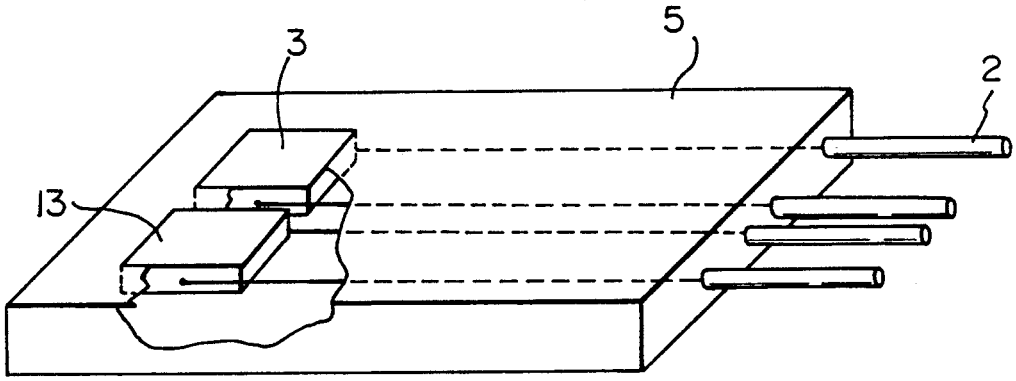
FIG. 2 is a perspective view of a gas sensor having a thermistor element for temperature compensation in this invention.

FIG. 2 is a perspective view of a typical embodiment of a gas sensor having, in combination, a thermistor element 3 of a square chip and a gas sensor element 13 for temperature compensation. That is, the gas sensor has a structure that the thermistor element 3 and the gas sensor element 13 are mounted on an electrical insulating support 5 such that at least part of the elements 3 and 13 are exposed.

Figure 3:
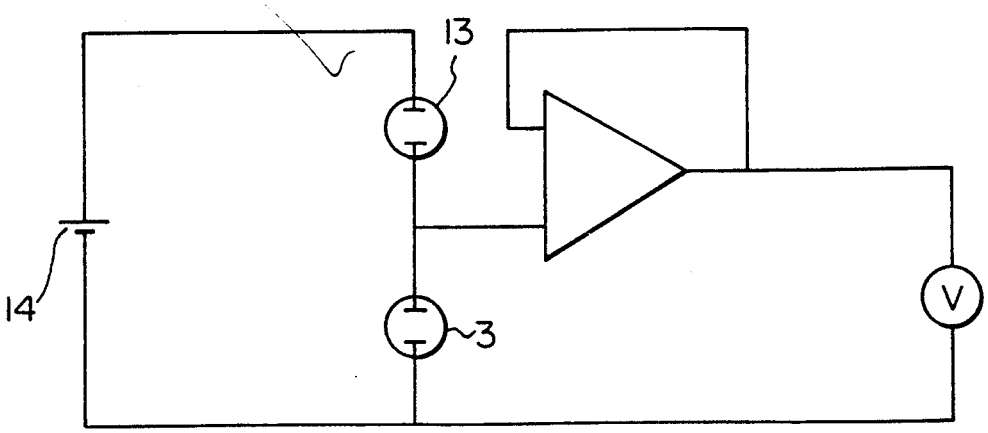
FIG. 3 shows a typical circuit pattern in the gas sensor.

In the typical circuit pattern of FIG. 3, the gas sensor 13 is connected in series with a circuit power source 14 and the thermistor element 3. The amount of vanadium dissolved is adjusted such that the temperature dependence of the resistance of the thermistor element 3 becomes the same as the temperature dependence of the gas sensor element 13 and voltages at both ends of the thermistor element 3 are then measured, thereby providing a gas sensor that can be used in a wide temperature region with the temperature dependence compensated.

Figure 4:
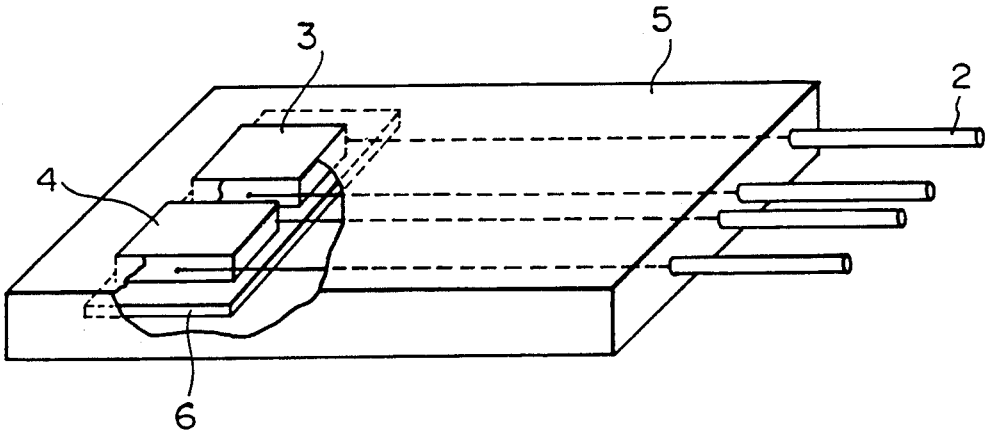
FIG. 4 is a perspective view of a gas sensor having the thermistor element of this invention and the gas sensor element for strictly sensing the gas concentration.

FIG. 4 is a perspective view showing a typical embodiment of a gas sensor having, in combination, a thermistor element 3 of a square chip and a gas sensor element 4 as well as a heater. Said gas sensor is utilized to strictly sense the gas concentration while controlling the temperature.

Figure 5:
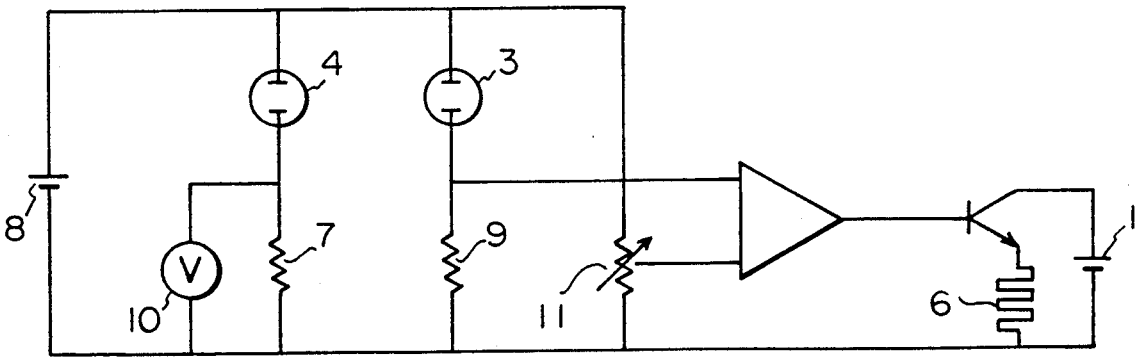
FIG. 5 is a typical circuit pattern in the gas sensor.

FIG. 5 shows the typical circuit pattern using the gas sensor of FIG. 4. That is, the gas sensor element 4 is connected in series with the circuit power source 8 and a negative resistor 7 via an electrode. A voltmeter 10 is connected in parallel with the negative resistor 7. Meanwhile, the thermistor element 3 is connected in series with a negative resistor 9 and the circuit power source 8. Voltages at both ends of the negative resistor are compared with a reference voltage given by a variable resistor 11 and electricity is passed through a heater 6 by controlling a voltage of the heater power source 12. In the above circuit, for the resistance of the thermistor element 3 to reach a predetermined value, the heater 6 is subjected to the on-off control action, and the temperature of the sensor element 4 thereby becomes constant too. Accordingly, if the gas sensor element 4 generates a power dependent on the concentration of the specific gas component, the gas concentration can be determined by the above circuit with good precision without any influence of the ambient temperature.

The gas sensor element having λ characteristics is generally great in temperature dependence of the resistance and is limited in its temperature range. However, when the gas sensor element is combined with the thermistor element of this invention, there can be obtained a gas sensor with the temperature dependence of the gas sensor element compensated.

EFFECTS

The thermistor element of this invention, when in direct contact with an exhaust gas discharged from an internal combustion engine, etc., can exhibit stable characteristics without being influenced by components of the exhaust gas, and is excellent in response under a high-temperature atmosphere. Moreover, it is also possible to adjust the resistance to one corresponding to the use conditions by changing the amount of vanadium dissolved.

Consequently, the thermistor element of this invention is effective for not only measuring the temperature of the exhaust gas in the electric oven but also controlling or compensating the temperature of the gas sensor element for sensing the specific components such as $O_2$, CO, NOx, etc.

EXAMPLES

The following Examples and Comparative Examples illustrate this invention in more detail. However, this invention is not limited thereto.

EXAMPLES 1 to 6 and COMPARATIVE Examples 1 to 2

$TiO_2$ and $V_2O_5$ were mixed at a Ti to V atomic ratio shown in Table 1 and burned in air at 1000° C. for 10 hours to dissolve vanadium. The resulting powder was charged in a cavity. After platinum electrodes were embedded in both sides thereof, compression-molding was conducted to form a chip of a shape shown in FIG. 1. Subsequently, the molded article was sintered in air at 1200° C. for 5 hours to obtain a sintered body.

Using the sintered body, an element resistance, an $O_2$ sensitivity, a CO sensitivity and a NOx sensitivity were measured and a durability was evaluated. On this occasion, the measuring conditions are as follows:

(1) Element resistance

A resistance in an $N_2$ atmosphere containing 5% of $O_2$ at 800° C. and 500° C.

(2) $O_2$ sensitivity

A ratio of a resistance R1 in $N_2$ and a resistance R2 in an $N_2$ atmosphere containing 10% of $O_2$ at 500° C. [log (R2/R1)].

(3) CO sensitivity

A ratio of a resistance R1 in an $N_2$ atmosphere containing 5% of $O_2$ and a resistance R2 in an $N_2$ atmosphere containing 5% of $O_2$ and 4000 ppm of CO at 500° C. [log (R2/R1)].

(4) NOx sensitivity

A ratio of a resistance R1 in an $N_2$ atmosphere containing 5% of $O_2$ and a resistance $R_2$ in an $N_2$ atmosphere containing 5% of $O_2$ and 3000 ppm of NOx at 500° C. [log (R2/R1)].

(5) Durability

A ratio of a resistance R1 and a resistance R2 before and after the molded article is left to stand in an $N_2$ atmosphere containing 5% of $O_2$ at 800° C. respectively [log (R2/R1)].

The results are shown in Table 1. From the results in Table 1, it follows that a thermistor element which has a high durability and a sensitivity to specific gas components and which allows a great change in element resistance with the change in amount of vanadium dissolved can be obtained by using titania having dissolved therein 0.01 to 10%, more preferably 0.02 to 2%, based on titanium, of vanadium. When the amount of vanadium is less than 0.01 at. % based on titanium, the sensitivity to specific gas components is poor. When it is more than 10 at. %, the durability is not enough.

Resistances were measured for the element in Example 4 at temperatures of from 800° C. to 400° C. under atmospheres containing various gas components. The results are shown in Table 2. The results of Table 2 reveals that the element of Example 4 shows the characteristics dependent on the temperature alone without being influenced by the gas components in the atmospheres.

TABLE 1

| | at. % of V based on Ti | Element resistance at 800° C. (ohm) | Element resistance at 500° C. (ohm) | $O_2$ sensitivity | CO sensitivity | NO sensitivity | Durability |
|---|---|---|---|---|---|---|---|
| Comparative Example 1 | 0.003 | $1.3 \times 10^4$ | $5.0 \times 10^6$ | 0.40 | −0.28 | 0.12 | 0.03 |
| Example 1 | 0.03 | $1.0 \times 10^4$ | $3.6 \times 10^6$ | 0.09 | −0.04 | 0.03 | 0.03 |
| Example 2 | 0.1 | $8.8 \times 10^3$ | $1.8 \times 10^6$ | 0.07 | −0.03 | 0.02 | −0.08 |
| Example 3 | 0.3 | $5.2 \times 10^3$ | $7.3 \times 10^5$ | 0.04 | −0.02 | −0.01 | −0.03 |
| Example 4 | 1 | $3.2 \times 10^3$ | $2.3 \times 10^5$ | 0.02 | −0.01 | −0.01 | −0.02 |
| Example 5 | 3 | $1.0 \times 10^3$ | $2.2 \times 10^5$ | 0.00 | −0.02 | 0.01 | 0.07 |
| Example 6 | 8 | $8.2 \times 10^2$ | $9.5 \times 10^3$ | 0.00 | −0.02 | 0.01 | 0.09 |
| Comparative Example 2 | 30 | $2.5 \times 10^2$ | $1.8 \times 10^3$ | 0.01 | −0.02 | −0.01 | 0.40 |

TABLE 2

| | Temperature dependence of element resistance (Unit: Ohm) | | | | |
|---|---|---|---|---|---|
| Atmosphere being measured | 800° C. | 700° C. | 600° C. | 500° C. | 400° C. |
| $N_2 + O_2$ 5% | $3.24 \times 10^3$ | $1.12 \times 10^4$ | $5.01 \times 10^4$ | $2.82 \times 10^5$ | $1.86 \times 10^6$ |
| $N_2 + O_2$ 5% + $NO_2$ 3000 ppm | $3.23 \times 10^3$ | $1.12 \times 10^4$ | $5.02 \times 10^4$ | $2.83 \times 10^5$ | $1.87 \times 10^6$ |
| $N_2 + O_2$ 5% + CO 4000 ppm | $3.24 \times 10^3$ | $1.11 \times 10^4$ | $5.01 \times 10^4$ | $2.81 \times 10^5$ | $1.86 \times 10^6$ |
| $N_2 + O_2$ 5% + $H_2$ 4000 ppm | $3.22 \times 10^3$ | $1.11 \times 10^4$ | $5.00 \times 10^4$ | $2.81 \times 10^5$ | $1.85 \times 10^6$ |

EXAMPLES 7 to 17 and COMPARATIVE EXAMPLES 3-4

$TiO_2$ and $V_2O_5$ were mixed at an atomic ratio of 100:1 and $Co_2O_3$, $MnO_2$, NiO, $SrCO_3$, CuO, $Fe_2O_3$, $Bi_2O_3$, $BaCO_3$, PbO or ZnO was further mixed at an atomic ratio shown in Table 3. The mixture was burned in air at 1000° C. for 10 hours to dissolve vanadium. The resulting powder was charged in a cavity, and platinum electrodes were embedded in both sides thereof. Subsequently, compression-molding was conducted to form a chip of a shape shown in FIG. 1. The molded article was then sintered in air at 1200° C. for 5 hours to obtain a sintered body.

Using the sintered body, an element resistance, an $O_2$ sensitivity, a CO sensitivity and a NOx sensitivity were measured and a durability was evaluated under the same conditions as in Table 1. From the results in Table 3, it becomes apparent that the other element such as CO, Mn, etc. may be contained if the amount is 10 at. % or less based on titanium.

TABLE 3

| | Element | at. % of each element based on titanium | Element resistance at 800° C. (ohm) | Element resistance at 500° C. (ohm) | $O_2$ sensitivity | CO sensitivity | NO concentration | Durability |
|---|---|---|---|---|---|---|---|---|
| Example 7 | | 5 | $2.8 \times 10^3$ | $1.8 \times 10^5$ | 0.02 | −0.01 | 0.03 | −0.02 |
| Example 8 | Mn | 1 | $3.5 \times 10^3$ | $3.0 \times 10^5$ | 0.02 | −0.02 | 0.03 | −0.03 |
| Example 9 | Mn | 5 | $3.3 \times 10^3$ | $3.5 \times 10^5$ | 0.01 | −0.01 | −0.02 | −0.02 |
| Example 10 | Ni | 5 | $4.2 \times 10^3$ | $3.8 \times 10^5$ | 0.03 | −0.03 | −0.01 | 0.03 |
| Example 11 | Cu | 5 | $3.0 \times 10^3$ | $3.2 \times 10^5$ | 0.03 | −0.02 | −0.02 | 0.02 |
| Example 12 | Fe | 5 | $3.8 \times 10^3$ | $3.5 \times 10^5$ | 0.02 | −0.03 | 0.03 | −0.02 |
| Example 13 | Bi | 5 | $3.1 \times 10^3$ | $3.2 \times 10^5$ | 0.03 | −0.02 | 0.02 | −0.03 |
| Example 14 | Ba | 5 | $4.5 \times 10^3$ | $5.8 \times 10^5$ | 0.01 | −0.02 | 0.01 | 0.01 |
| Example 15 | Sr | 5 | $4.0 \times 10^3$ | $4.2 \times 10^5$ | 0.01 | −0.01 | 0.02 | 0.03 |
| Comparative Example 3 | Sr | 13 | $5.3 \times 10^3$ | $6.9 \times 10^5$ | 0.15 | −0.09 | 0.09 | 0.35 |
| Comparative Example 4 | Ni | 20 | $4.8 \times 10^3$ | $5.5 \times 10^5$ | 0.12 | −0.10 | 0.13 | 0.47 |
| Example 16 | Pb | 5 | $3.3 \times 10^3$ | $2.8 \times 10^5$ | 0.01 | −0.01 | −0.02 | −0.03 |
| Example 17 | Zn | 5 | $4.6 \times 10^3$ | $5.3 \times 10^5$ | 0.02 | −0.03 | −0.02 | −0.01 |

EXAMPLE 18 and COMPARATIVE EXAMPLE 5

A NOx sensor shown in FIG. 4, comprising a thermistor element composed of titania having dissolved therein 1 at. % of vanadium which was obtained in Example 4 and a NOx sensor element having a composition of $Al_{0.01}Ti_{0.99}O_{2-\delta}$ was produced and incorporated in a circuit shown in FIG. 5 to provide a temperature-proof NOx sensor. For comparison, a NOx sensor was produced using as a thermistor element an element wherein a NOx sensor element was sealed with a glass to isolate it from the ambient atmosphere.

Figure 6:
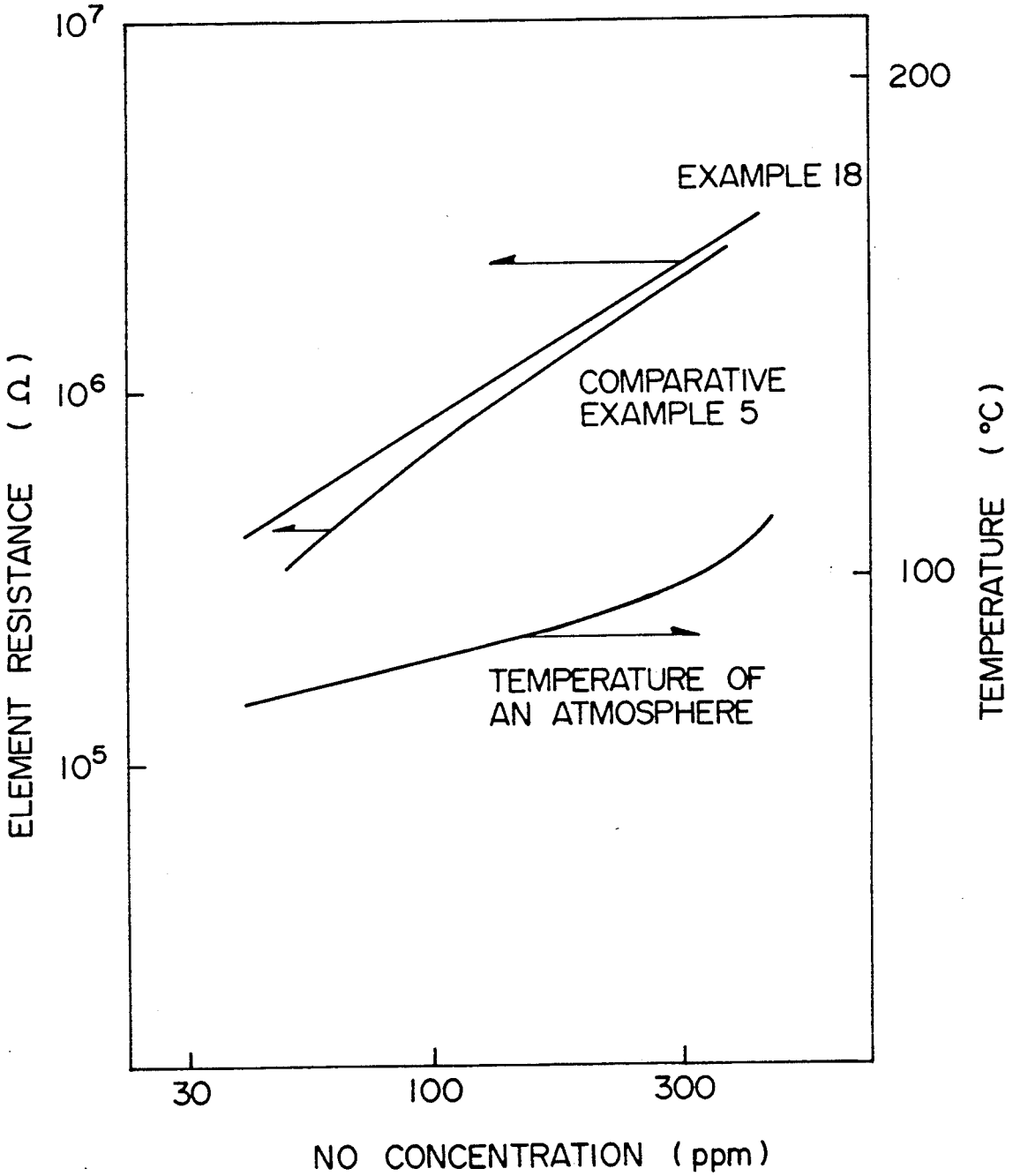
FIG. 6 shows a relationship between an NO concentration and a resistance of an element when the NO concentration of the gas is measured via the gas sensor of this invention.

The sensing portion of the sensor was installed under such environment that an NO concentration and a temperature were changed as shown in Table 4. The NOx concentration was measured while controlling a voltage of a heater such that the temperature of the gas (NOx) sensor element was kept constant by a power generated from the thermistor element. The above measurement was conducted five seconds after the NOx concentration and the temperature were changed. The results are shown in Table 4 and FIG. 6. From said results, it follows that when using the thermistor element of this invention, the temperature can be controlled with high precision and the NO concentration be measured accurately owing to the excellent response and stability of the thermistor element.

TABLE 4

| Temperature (°C.) | | 77 | 84 | 88 | 92 | 95 | 98 | 101 |
|---|---|---|---|---|---|---|---|---|
| NO (ppm) | | 50 | 100 | 150 | 200 | 250 | 300 | 350 |
| Element resistance (Ohm) | Example 18 | $4.8 \times 10^5$ | $8.4 \times 10^5$ | $1.2 \times 10^6$ | $1.5 \times 10^6$ | $1.8 \times 10^6$ | $2.1 \times 10^6$ | $2.3 \times 10^6$ |
| | Comparative Example 5 | $3.4 \times 10^5$ | $7.0 \times 10^5$ | $1.0 \times 10^6$ | $1.3 \times 10^6$ | $1.6 \times 10^6$ | $1.9 \times 10^6$ | $2.2 \times 10^6$ |

What we claim is:

1. A thermistor element consisting essentially of a vanadium-containing titania having dissolved therein 0.01 to 10 at. %, based on titanium, of vanadium and optionally 10 at. % or less, based on titanium, of at least one element selected from the group consisting of cobalt, copper, manganese, iron, nickel, bismus, strontium, barium, lead and zinc.

2. The thermistor element of claim 1 wherein the vanadium-containing titania is one having dissolved therein 0.01 to 8 at. %, based on titanium, of vanadium.

3. A gas sensor comprising 1) an electrical insulating support,
2) the thermistor element of claim 1 incorporated in the support such that a sensing portion is exposed, and
3) a gas sensor element incorporated in the support such that a sensing portion is exposed.

4. The gas sensor of claim 3 wherein the thermistor element and the gas sensor element are adjusted such that their resistances are approximately equal.

5. A gas sensor comprising 1) an electrical insulating support,
2) the thermistor element of claim 1 incorporated in the support such that a sensing portion is exposed,
3) a gas sensor element incorporated in the support such that a sensing portion is exposed, and
4) a heating means for heating the thermistor element and the gas sensor element at the same temperature.

6. The thermistor element of claim 1 wherein the vanadium-containing titania is one having dissolved therein 0.02 at. %, based on titania, of vanadium.

7. The thermistor element of claim 1 further comprising 0.5 to 7 at. % of at least one element selected from the group consisting of cobalt, copper, zinc, manganese, iron, nickel, bismuth, lead, strontium and barium.

8. The thermistor element of claim 7 wherein the vanadium containing titania is molded by sintering.

* * * * *